US006145232A

United States Patent [19]

Bevins

[11] Patent Number: 6,145,232

[45] Date of Patent: Nov. 14, 2000

[54] SIGN HOLDER FOR SHELVES WITH C-CHANNELS

[75] Inventor: Earle Bevins, Itasca, Ill.

[73] Assignee: Fast Industries, Inc., Fort Lauderdale, Fla.

[21] Appl. No.: 09/314,938

[22] Filed: May 20, 1999

[51] Int. Cl.[7] ..... G09F 3/18

[52] U.S. Cl. ..... 40/661.03; 40/661.08; 40/661

[58] Field of Search ..... 40/642.02, 661.03, 40/661.08, 661, 642.01, 654.01, 658, 666

[56] References Cited

U.S. PATENT DOCUMENTS

| | | | |
|---|---|---|---|
| 2,592,386 | 4/1952 | Breakey . | |
| 2,811,796 | 11/1957 | Schoelles | 40/661 |
| 3,977,112 | 8/1976 | Breer, II . | |
| 4,144,661 | 3/1979 | Gosanko et al. | 40/661 |
| 4,449,310 | 5/1984 | Kline | 40/658 |
| 4,485,575 | 12/1984 | Fast . | |
| 4,545,140 | 10/1985 | Winston . | |
| 4,563,796 | 1/1986 | Kettlestrings | 40/666 X |
| 4,671,002 | 6/1987 | Fast . | |
| 4,716,669 | 1/1988 | Fast . | |
| 4,718,627 | 1/1988 | Fast et al. . | |
| 5,419,066 | 5/1995 | Harnois et al. . | |
| 5,473,833 | 12/1995 | Ostrovsky | 40/658 |
| 5,488,793 | 2/1996 | Gebka et al. . | |
| 5,511,332 | 4/1996 | Sturkie et al. . | |
| 5,682,698 | 11/1997 | Bevins . | |

OTHER PUBLICATIONS

Fast Ind. Label Holders & Merchandisers Catalog & Price List, pp. 1–12.

Fast EZ–View, Retail Label Holders and Sign Holders, Catalog, vol. 2, 4 pages.

Fast® Industrial Bar Code Label Holders, Catalog/Price List, vol. 3, 12 pages.

Fasteners for Retail, 1996 Buyers Guide, pp. 1–83.

Fast Extruding & Molding, EZ–View Label Placement & Merchandising Systems, Catalog, vol. 1, pp. 1–19.

Fast Industries, Inc. Label Holders, Strip Merchandisers, Sign Holders, P.O.P. Accessories, Shelf Dividers, . . . Catalog vol. 1, pp. 1–45.

*Primary Examiner*—Anthony Knight
*Assistant Examiner*—James M Hewitt
*Attorney, Agent, or Firm*—Jacobson, Price, Holman & Stern, PLLC

[57] ABSTRACT

A transparent plastic sign holder is designed to fit in C-channels of different heights along the front edges of merchandise display shelves. The sign holder is a plastic sheet with a backwardly folded, downwardly depending, first flap integrally connected to the upper edge of the main body panel of the sign holder, and a backwardly folded, upwardly extending second flap integrally connected to the lower edge of the main body panel. A sign can be slidingly engaged behind the transparent main body panel in the bights formed at the connection with the first and second flaps. The second flap has yet another or third backwardly folded, downwardly depending, flap integrally connected to its upper edge. The first and third flaps each have freely extending lower edge portions and have different heights corresponding to the heights of two different C-channels with which the sign holder is to be used. The lower edge portions of the first flap can either be positioned behind the third flap or between the second flap and the main body panel to expose either the first or third flap for engagement with a C-channel of a corresponding height without the need to invert the sign holder for use with different height C-channels.

7 Claims, 4 Drawing Sheets

SIGN HOLDER FOR SHELVES WITH C-CHANNELS

BACKGROUND OF THE INVENTION

This invention relates to a sign holder for use with merchandise display shelves of the type in which the shelves have C-channels formed along the front edge. Shelves with C-channels are commonly found in merchandise outlets such as supermarkets and the like and the C-channels, being formed with upper and lower lips, form a convenient means for mounting many different kinds of fit-in articles such as labels, signs or sign holders which provide information relating to merchandise displayed on a shelf.

One criterion which is applicable to the design of articles such as sign holders adapted to be fitted into a C-channel, is the size, particularly the height, of the channel itself, since variations in channel height can affect the fit of an article in the channel. While small variations in height between different C-channels having nominally the same dimensions can generally be accommodated by prior art articles of this type since a perfect fit is not necessary for most purposes, it is not unusual to find different shelves with significantly different size C-channels. Such variations in C-channel dimensions must, therefore, be taken into account in the design of fit-in sign holders and the like. Heretofore, it has been common practice to stock a multiplicity of different size articles which are otherwise identical in function in order to accommodate shelves with different size C-channels.

In my U.S. Pat. No. 5,682,698 granted Nov. 4, 1997, (the '698 patent) I disclosed a versatile plastic sign holder which is designed to fit in C-channels of two different heights. The sign holder of the '698 patent is a plastic sheet with backwardly folded flaps of different heights integrally attached to the top and bottom edges of the main body panel of the sign holder. The two flaps form oppositely facing pockets between which a sign or paper label can be fitted against the back face of the holder to be seen through the transparent main body panel. In use, the sign holder can be reversed for selective engagement of one flap or the other in a C-channel of a corresponding height.

The sign holder of the '698 patent provides significant advantages when compared to previously available constructions requiring an inventory of multiple sign holders, each adapted to fit a single C-channel configuration. However, in order to make use of the versatility of the sign holder of my prior patent, it is necessary to remove and reverse the sign itself within the sign holder before the sign holder could be inverted to be fitted to a C-channel of a different height. Such a procedure subjects the sign to possible damage and, additionally, is somewhat labor-intensive.

SUMMARY OF THE INVENTION

It is primary object of the present invention, therefore, to provide a sign holder adapted to fit C-channels of different heights, without the necessity to remove the sign or to reverse the sign holder when moving the same from one C-channel to another.

It is another object of this invention to provide a sign holder of simple and economical manufacture which can be used on shelves having C-channels of somewhat differing heights by simply adjusting the position of C-channel engaging flaps without the need to invert the sign or sign holder in use.

Accordingly, the invention provides a sign holder comprising a sheet of plastic having a transparent main body panel with backwardly folded flaps or flanges integrally connected to its top and bottom edges to form opposed pockets for removable reception of a sign or label or the like as in the '698 patent. However, the lower flap of the sign holder of this invention has yet another backwardly folded flap integrally connected to its top edge so that there are two downwardly depending flaps of different heights. By providing two flaps of different dimensions, each of which has a free lower edge portion to be engaged in the lower sign holder-engaging lip on a C-channel, the sign holder of the instant invention can be selectively secured in different C-channels without the need to remove and reverse the sign. In contrast, the sign holder of the '698 patent has one upwardly extending and one downwardly depending flap each with its own with free edge portions necessitating inversion of the sign holder for engagement with different C-channels.

According to a preferred construction of the sign holder of the instant invention, the upwardly extending portion of the flap attached to the bottom edge of the main body panel is larger than the downwardly depending flap attached to the top edge of the main body panel and the sum of the height of those flaps is greater than the overall height of the main body panel. In this way, the free lower edge portions of the upper flap can be positioned behind the upwardly extending portion of the lower flap if the upper flap is to be used to secure the sign holder to the C-channel. On the other hand, if the downwardly depending portion of the lower flap is to be used to secure the sign holder to a C-channel of a different height, the free lower edges of the upper flap can be positioned between the back of the main body panel and the front of the upwardly extending portion of the lower flap to free the downwardly depending portion of the lower flap for engagement in the C-channel.

Additional features and advantages of the invention will become apparent from the ensuing description and claims read in conjunction with the attached drawings.

DETAILED DESCRIPTION OF THE PREFERRED EMBODIMENTS

Figure 1:
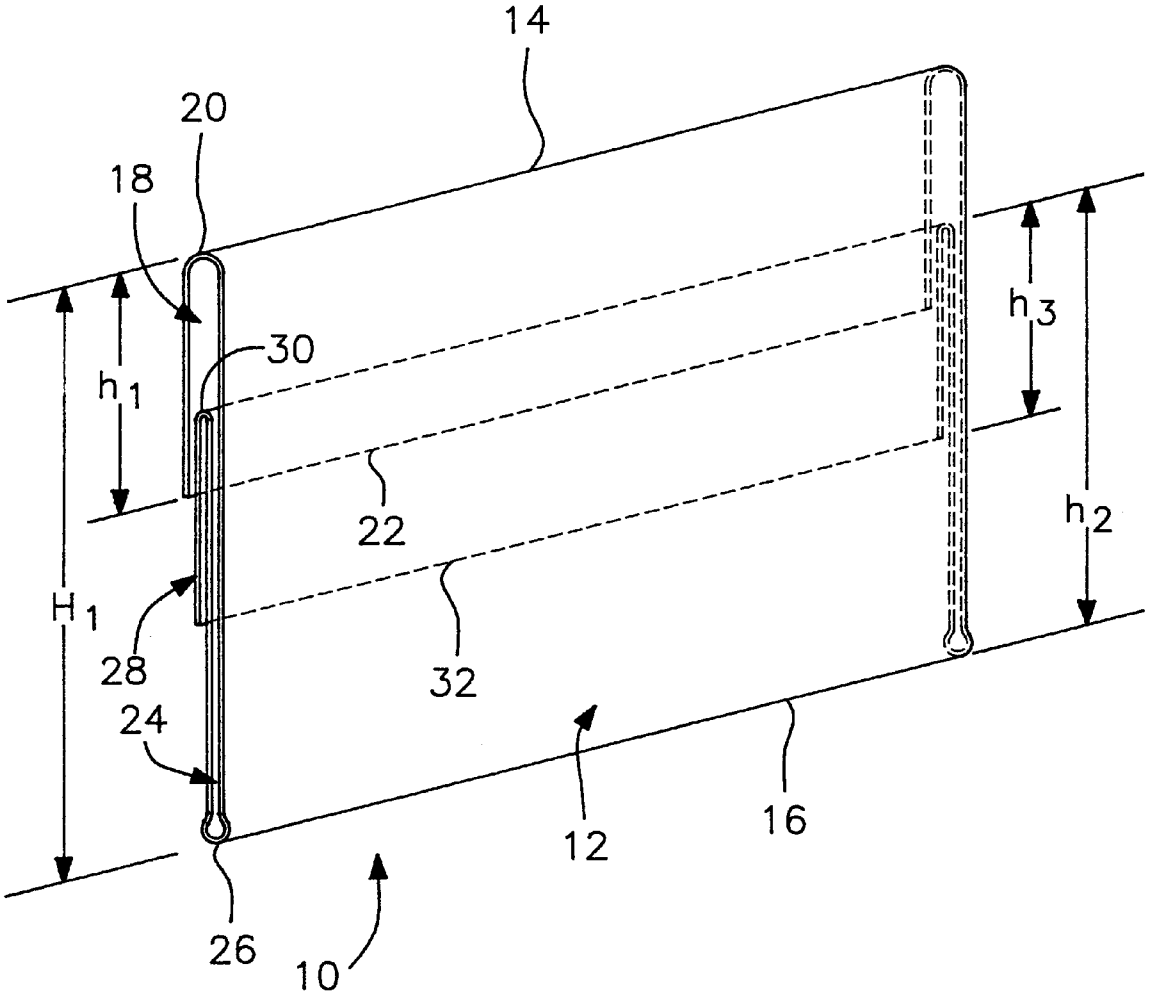
FIG. 1 is a perspective view of a preferred embodiment of a sign holder according to the invention configured for use with a C-channel having a height dimension generally corresponding to the height of the upper flap.

As seen in FIG. 1, a sign holder 10 according to the instant inventive concepts is cut, e.g., by guillotine, from a strip of suitable width transparent plastic sheeting of any conventional material. The sign holder 10 comprises portions defining a transparent main body panel 12 of a height $H_1$ between its upper and lower edges 14, 16. A first flap 18 is integrally connected to the upper edge 14 of the body panel 12 by a heat-folded resilient bight portion 20 and extends downwardly to freely extending lower edge portions 22. The first flap 18 has a height $h_1$ between the bight portion 20 and the free lower edge portions 22.

A second flap 24 extends upwardly from the lower edge 16 of the body panel 12 and is integrally connected thereto by a second resilient bight portion 26. The second flap 24, in turn, is integrally connected to a downwardly depending third flap 28 at its upper end by a third resilient bight portion 30, and the third flap 28 terminates in freely extending lower edge portions 32. The second flap 24 has a height $h_2$ between the bight portions 26 and 30 and the third flap 28 has a height $h_3$ between the bight portion 30 and the freely extending lower edge portions 32.

Figure 2:
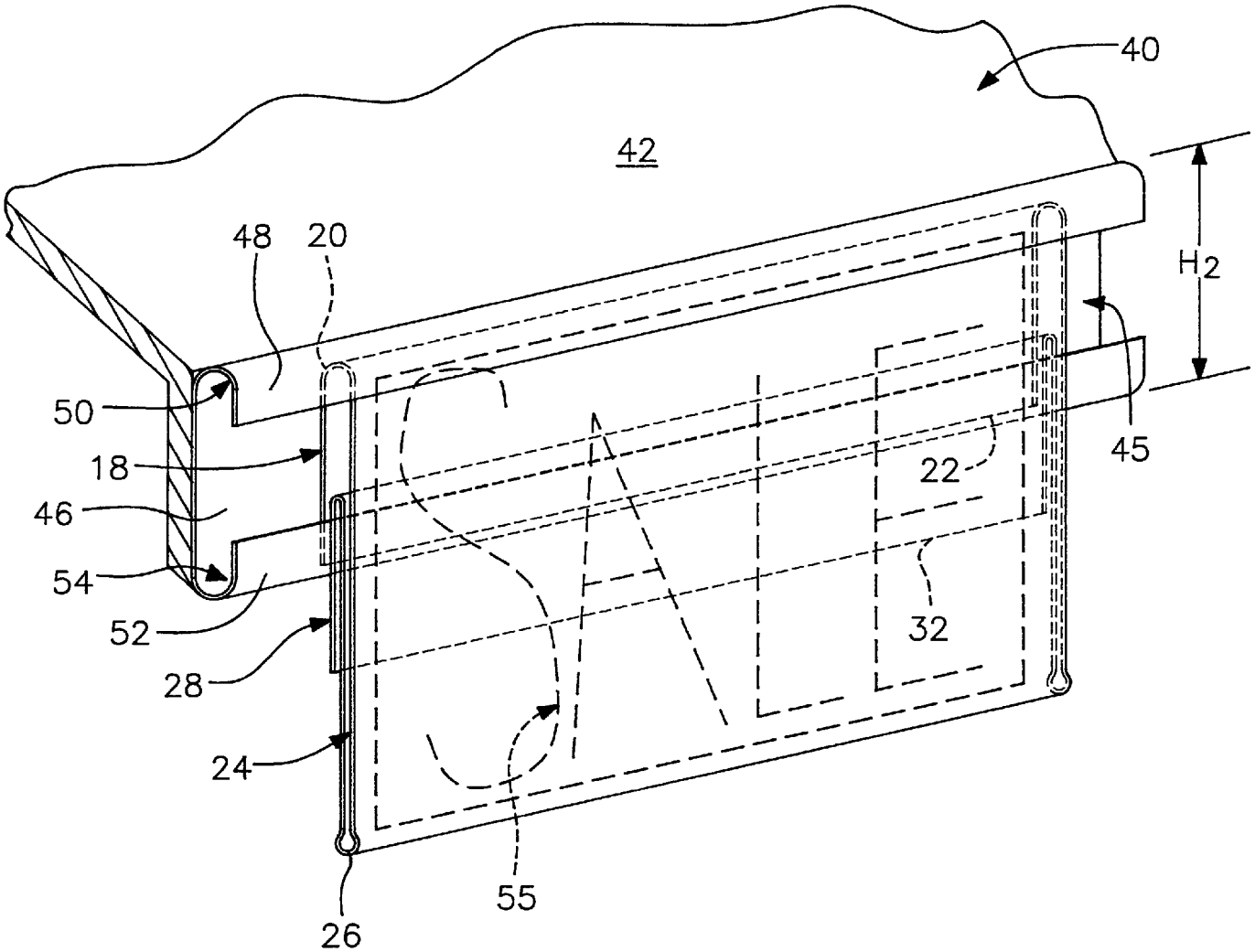
FIG. 2 is a perspective view of the sign holder configured as shown in FIG. 1 mounted in such a C-channel.

Referring now to FIG. 2, a merchandise display shelf is designated generally by the reference numeral 40 and comprises an upper surface 42 for the display of products (not shown). A C-channel 45 depends from the front edge of the shelf 40 and includes a central section 46, an upper lip 48 and a lower lip 52. The upper lip 48 extends forwardly from the upper edge of the central section 46 of the C-channel and defines, with the front face of the central section 46, a downwardly opening, upper sign holder-receiving channel 50. The lower lip 52 extends forwardly from the lower edge of the central section 46 and defines, together with the front face of the central section 46, an upwardly opening, lower sign holder-receiving channel 54. The distance between the upper and lower sign holder-receiving channels 50, 54 is the height $H_2$ of the C-channel 45.

For purposes of illustration, the height $H_2$ of the C-channel 45 is approximately the same as the height $h_1$ of the first flap 18 of the sign holder 10. In use with a C-channel having a height $H_2$, a sign 55 to be seen through the transparent main body panel 12 of the sign holder 10, is slidingly inserted behind the back face of the main body panel 12 in front of the front faces of the first and second flaps 18, 24, with its upper and lower edges secured within the first and second bight portions 20, 26. Then, the sign holder 10 is engaged in the C-channel 45 by securing the first bight portion 20 in the upper sign holder-receiving channel 50 behind the upper lip 48, with the freely extending lower edge portions 22 of the first flap 18 engaged in the lower sign holder-receiving channel 54 behind the lower lip 52. In this manner, the information displayed on the sign 55 is viewable to a consumer passing by the merchandise display shelf 40 through the transparent main body panel 12.

Figure 3:
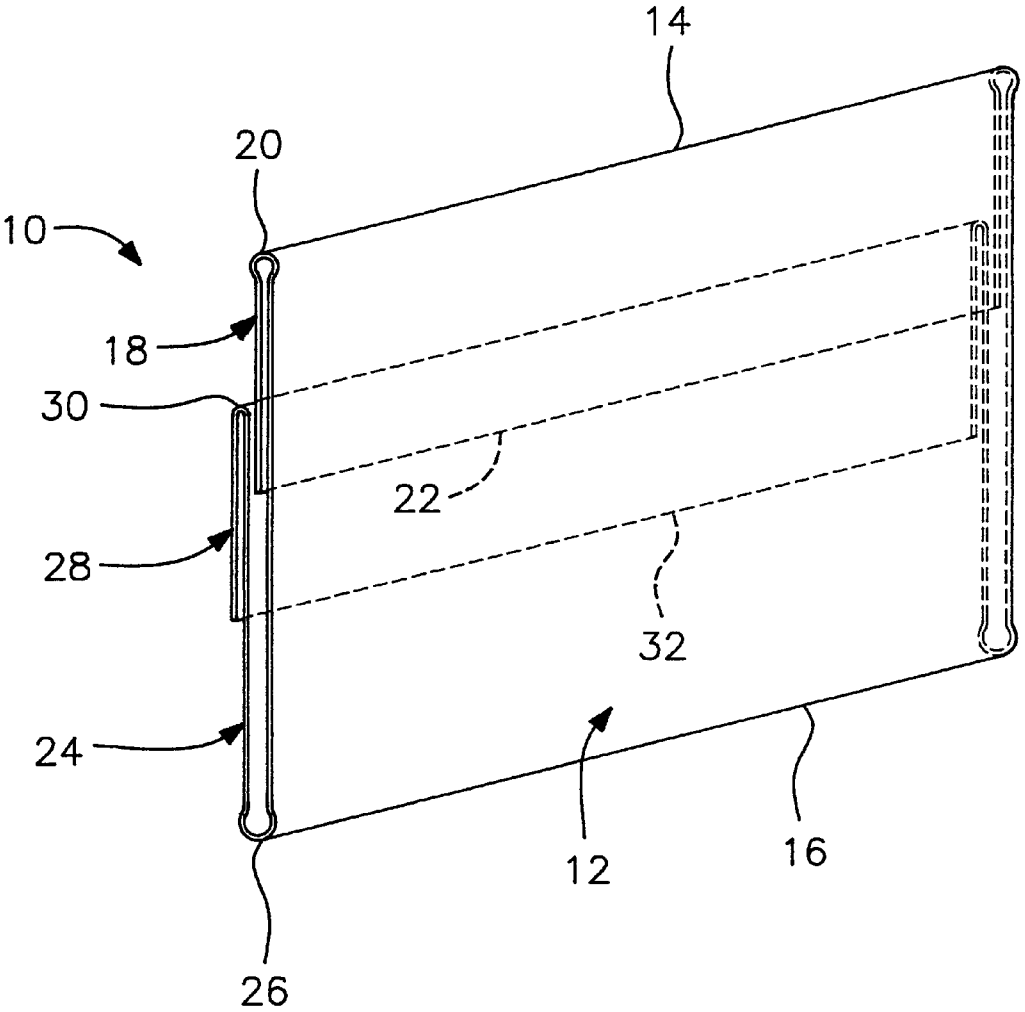
FIG. 3 is a perspective view of the sign holder of FIG. 1 reconfigured to adapt the same for engagement with a C-channel having a height dimension generally corresponding to the height of the downwardly depending portion of the lower flap.
Figure 4:
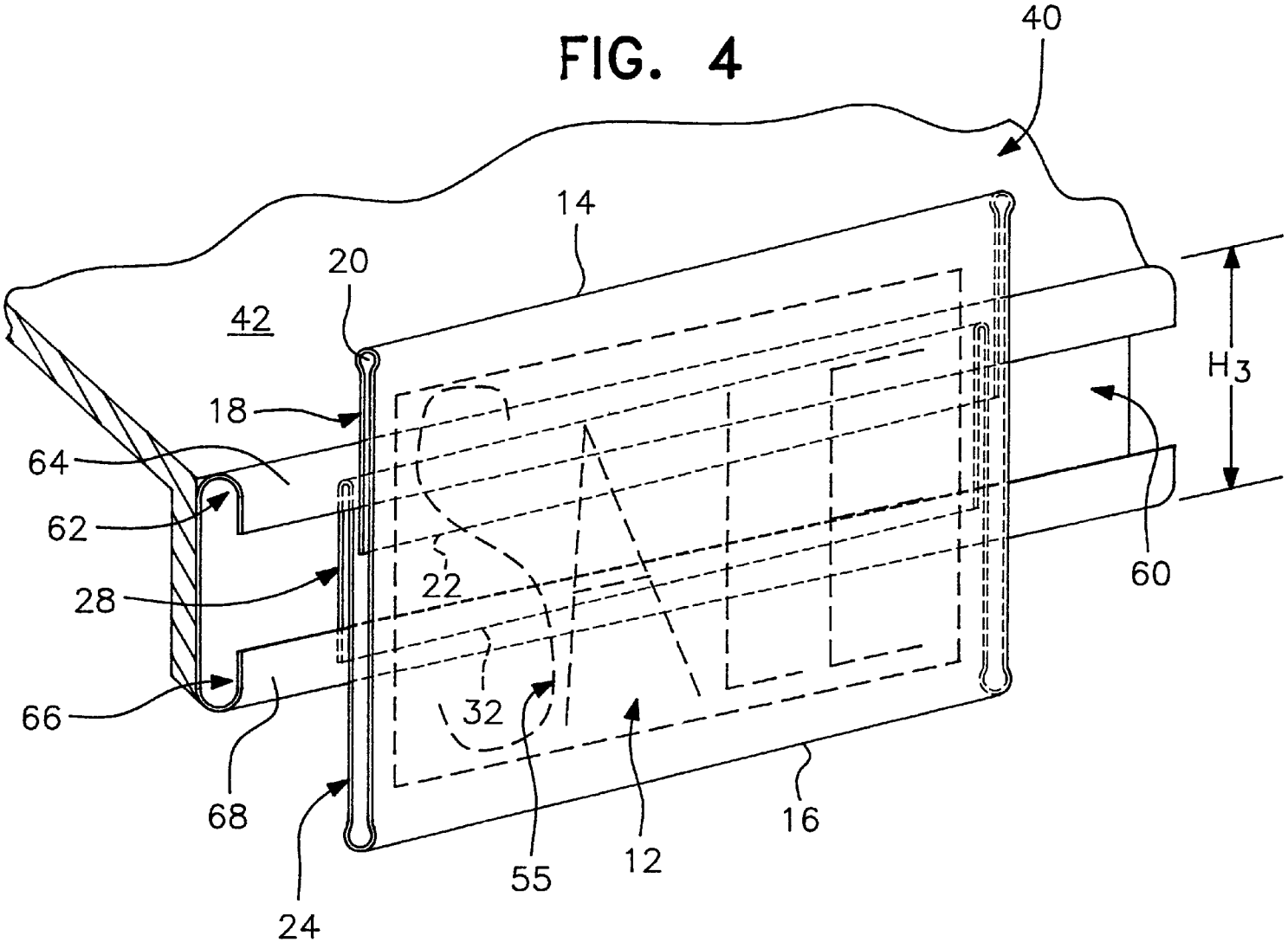
FIG. 4 is a perspective view of the sign holder reconfigured as shown in FIG. 3 and fitted to a C-channel of the appropriate dimension.

With reference now to FIGS. 3 and 4, the sign holder 10 is reconfigured for attachment to a C-channel 60 of a different height $H_3$ between an upper sign holder-receiving channel 62 behind an upper lip 64 and a lower sign holder-receiving channel 66 behind a lower lip 68. The height $H_3$ of the C-channel 60 corresponds generally to the height $h_3$ of the third flap 28 of the sign holder 10. In order to expose the third flap 28 of the sign holder 10 for engagement with the C-channel 60, the free lower edge portions 22 of the first flap 18 are interposed between the back face of the main body panel 12 and the upper portions of the front face of the second flap 24 as seen, particularly, in FIG. 3. In this configuration, the third bight portion 30 interconnecting the second and third flaps can be secured in the upper sign holder-receiving channel 62 and the free lower edge portions 32 of the third flap 28 can be secured in the lower sign holder-receiving channel 66.

Thus, by simply repositioning the lower portions of the first flap 18 between the configuration shown in FIG. 1 and the configuration shown in FIG. 3, the sign holder 10 is adapted to be engaged in C-channels 45, 60 of two different heights. There is no need to remove or reverse the sign 55 when selectively engaging the sign holder 10 in either of the C-channels.

It is to be noted that the height $h_3$ of the third flap 28 is smaller than the height $h_2$ of the second flap 20, although, if desired, it could be the same as the height $h_2$ for use with particularly large C-channel. Having the height $h_3$ of the third flap less than the height $h_1$ of the first flap and, therefore, obviously less than the height $h_2$ of the second flap, enables the majority of the sign holder 10 to be disposed below the upper surface of the shelf so as to minimize any interference when placing and removing products from the shelf.

Also, the sum of the heights $h_1$ and $h_2$ is preferably greater than the height $H_1$ of the main body panel, thereby enabling the lower portions of the first flap 18 to be engaged behind the second flap 28 in the manner shown in FIGS. 3 and 4 when reconfiguring the sign holder for use with a C-channel such as shown at 60.

The particular dimensions of the sign holder 10 can be modified for use with C-channels of any height, and do not form a critical part of the instant inventive concepts. For example, the height $H_1$ of the main body panel can be 3⅝", the height $h_1$ of the first flap 18 can be 1 15/16" and the height $h_3$ of the third flap 28 can be 1 9/32". Alternatively, the height $h_1$ of the first flap can be 1¼" and the height $h_3$ of the third flap 28 can be 1⅛" if the height of the C-channels with which the sign holder 10 is to be used are of those dimensions.

Considering the foregoing explanation, it will be recognized that the sign holder of this invention offers the versatility of a sign holder such as shown in my U.S. Pat. No. 5,682,698 for use with C-channels of different heights, while avoiding the need to remove and reverse a sign carried by the sign holder when it is desired to move the sign holder from one C-channel to a C-channel of a different height.

While only a preferred embodiment of the invention has been described herein in detail, the invention is not limited thereby and modifications can be made within the scope of the attached claims.

What is claimed is:

1. A sign holder formed of a transparent sheet material and adapted to fit in C-channels along front edges of respective merchandise display shelves, said sign holder comprising portions defining a transparent main body panel having a front face, a back face, an upper edge, and a lower edge, the distance between said upper and lower edges of said body panel defining the height of said body panel, first and second flaps extending from said upper and lower edges of said body panel, respectively, behind, and in spaced, generally parallel relation, to said back face of said body panel, said first and second flaps each including a front face, a back face, an upper edge, and a lower edge, the distance between said upper and lower edges of said first and second flaps defining the height of said first and second flaps, respectively, a first resilient bight portion integrally connecting said upper edge of said body panel and said first flap, a second resilient bight portion integrally connecting said lower edge of said body panel and said second flap, and a third flap extending behind and in spaced, generally parallel relation, to said back face of said second flap, said third flap having a front face, a back face, an upper edge and a lower edge, the distance between said upper and lower edges of said third flap defining the height of said third flap, and a third resilient bight portion integrally connecting said upper edges of said second and third flaps, said lower edges of said first and third flaps defining free lower edge portions, said height of said first and third flaps being different from each other and generally corresponding, respectively, to the differing height between upper and lower forwardly extending lips of C-channels with which the sign holder is to be used, whereby a sign may be removably carried between said first and second bight portions, behind said back face of said main body panel, and one of said first and third flaps is selectively engageable between the upper and lower lips of a C-channel of corresponding height, wherein the height of said second flap is greater than the height of said first flap, and the sum of said heights of said first and second flaps exceeds said height of said body panel, whereby, with said free lower edge portions of said first flap interposed between said back face of said body panel and said front face of said second flap, said third flap is engageable in a C-channel having a height corresponding to said height of said third flap, and with said free lower edge portions of said first flap positioned behind said back face of said third flap, said first flap is engageable in a C-channel having a height corresponding to said height of said first flap.

2. A sign holder as claimed in claim 1 wherein said sheet material is plastic, and said bight portions interconnecting said body panel to said first and second flaps and said bight portion interconnecting said second and third flaps, are defined by heat folds in the plastic.

3. A sign holder as claimed in claim 1 wherein said height of said third flap is no greater than said height of said second flap.

4. In combination, a merchandise display shelf having an elongated front edge, a C-channel depending from said front edge of said shelf, said C-channel comprising a central section including a front face and upper and lower edges, an upper lip extending forwardly from said upper edge of said central section of said C-channel and defining, together with said front face of said central section of said C-channel, a downwardly opening, upper sign holder-receiving channel, and a lower lip extending forwardly from said lower edge of said central section of said C-channel and defining, together with said front face of said central section of said C-channel, an upwardly opening, lower sign holder-receiving channel, the distance between said upper and lower sign holder-receiving channels defining the height of said C-channel, and a sign holder according to claim 1, one of said first and third flaps having a height generally corresponding to said height of said C-channel and the other of said first and third flaps having a height different from said height of said C-channel, the bight portion at the upper edge of said one flap being engaged within said upper sign holder-receiving channel of said C-channel, and the free lower edge portions of said one flap being engaged within said lower sign holder-receiving channel of said C-channel, whereby, said sign holder may be selectively disengaged from said C-channel so that said other flap can be engaged in a different C-channel having a height corresponding to the height of said other flap.

5. A combination according to claim 4, further including a sign having upper and lower edges received behind said body panel of said sign holder with said upper and lower edges of said sign engaged between said first and second bight portions of said sign holder.

6. A combination according to claim 4, wherein said height of said C-channel corresponds generally to said height of said first flap of said sign holder, and said free lower edge of said first flap are positioned behind said back face of said third flap and engaged in said lower sign holder-receiving channel of said C-channel with said first bight portion of said sign holder engaged in said upper sign holder-receiving channel of said C-channel.

7. A combination according to claim 4, wherein said height of said C-channel corresponds generally to said height of said third flap, and said free lower edge portions of said first flap are interposed between said back face of said body panel and said front face of said second flap of said sign holder, said free lower edge portions of said third flap being engaged in said lower sign holder-receiving channel of said C-channel, and said third bight portion of said sign holder engaged in said upper sign holder-receiving channel of said C-channel.

* * * * *